US009604380B2

(12) United States Patent
Wong

(10) Patent No.: US 9,604,380 B2
(45) Date of Patent: Mar. 28, 2017

(54) MANDOLIN SLICER KIT ASSEMBLY

(71) Applicant: King's Flair Development Ltd., Hong Kong (HK)

(72) Inventor: S. W. Alex Wong, Hong Kong (HK)

(73) Assignee: KING'S FLAIR DEVELOPMENT LTD., Hong Kong (HK)

( * ) Notice: Subject to any disclaimer, the term of this patent is extended or adjusted under 35 U.S.C. 154(b) by 125 days.

(21) Appl. No.: 13/920,715

(22) Filed: Jun. 18, 2013

(65) Prior Publication Data

US 2014/0366699 A1 Dec. 18, 2014

(51) Int. Cl.

| | |
|---|---|
| ***B26D 3/28*** | (2006.01) |
| ***B26D 7/26*** | (2006.01) |
| ***B26D 11/00*** | (2006.01) |

(52) U.S. Cl.

CPC ..... *B26D 3/283* (2013.01); *B26D 7/2614* (2013.01); *B26D 11/00* (2013.01); *B26D 2003/285* (2013.01); *B26D 2003/286* (2013.01); *B26D 2003/287* (2013.01); *B26D 2003/288* (2013.01); *Y10T 83/9457* (2015.04)

(58) Field of Classification Search

CPC ..... B26D 2003/283; B26D 2003/285; B26D 7/2614; A47B 57/30; A47B 57/40; A47B 57/404; A47B 57/56; A47B 57/562; A47B 57/061; A47B 57/066; B65D 83/0876; B65D 83/0894; B65D 83/0888

USPC ..... 83/698.11, 856, 703; 241/94, 37.5; 30/278, 279.2, 279.4; 221/220, 235, 206, 221/243, 271, 289–301; 206/354–355; 248/125.2, 141, 169, 693, 593, 617, 27.4, 248/27.3; 211/188, 49.1, 85.29; 403/325, 403/327

See application file for complete search history.

(56) References Cited

U.S. PATENT DOCUMENTS

| | | | | | |
|---|---|---|---|---|---|
| 2,570,046 | A * | 10/1951 | Burns | 312/9.27 |
| 2,640,347 | A * | 6/1953 | Majeski | 70/456 R |
| 3,771,223 | A * | 11/1973 | Dawidowicz et al. | 30/40 |
| 4,932,641 | A * | 6/1990 | Thomas et al. | 269/43 |
| 7,392,969 | B2 * | 7/2008 | Chiu et al. | 248/676 |
| 7,413,078 | B2 * | 8/2008 | Fischer | B26B 21/40 206/354 |

(Continued)

OTHER PUBLICATIONS

SafeHands, Inc., Jaccard, mandolin slicer, Oct. 21, 2010.*

*Primary Examiner* — Stephen Choi
*Assistant Examiner* — Fernando Ayala
(74) *Attorney, Agent, or Firm* — Nyemaster Goode P.C.

(57) ABSTRACT

The present invention discloses a mandolin slicer kit assembly comprising: a main body having two opposite side panels; a cutting blade mounted on the main body; a slicing plate carrier mounted between the two side panels of the main body; a plurality of slicing plates of different types, each of the slicing plates having a plurality of slicing teeth mounted on a top surface thereof and at least one recess formed on a bottom surface thereof; and an adapter plate having a leading portion, wherein said leading portion has at least one elastic rib for detachable engagement with the at least one recess of the slicing plate to form a slicing plate assembly, and said slicing plate assembly detachably is mounted on the slicing plate carrier. The mandolin slicer further comprises a slicing plate holder separate from all of the main body, the cutting blade, the slicing plate carrier, and the adapter plate.

12 Claims, 14 Drawing Sheets

(56) References Cited

U.S. PATENT DOCUMENTS

| | | | | |
|---|---|---|---|---|
| 7,694,615 | B2 * | 4/2010 | DiPietro | 83/425.3 |
| 2010/0096532 | A1 * | 4/2010 | Greve | 248/477 |
| 2012/0180612 | A1 * | 7/2012 | Holcomb | B26D 1/06 83/613 |
| 2012/0180616 | A1 * | 7/2012 | Tracy | 84/307 |
| 2013/0062300 | A1 * | 3/2013 | Drake | 211/183 |
| 2013/0266282 | A1 * | 10/2013 | Cote et al. | 385/135 |

* cited by examiner

A - A

B - B

B - B

MANDOLIN SLICER KIT ASSEMBLY

FIELD OF THE INVENTION

The present invention relates to the field of kitchen utensils, and more specifically relates to a mandolin slicer kit assembly for slicing a food item, which allows for interchange of slicing plates of variable slicing teeth to achieve variable slicing patterns without the need of direct contact between a user and the slicing plates thereby preventing hands of the user from getting hurt.

BACKGROUND OF THE INVENTION

It is well known that mandolin slicers are generally used to slice food items like potatoes and cucumbers etc. A chef may require variable slicing patterns when preparing food slices. For this purpose, mandolin slicers available in the prior art usually comprises different types of slicing plates for realizing different slicing patterns. However, the slicing plates may hurt the hands of the user as he has to directly contact with the slicing plates to achieve the interchange of the slicing plates.

For example, U.S. application No. US2007/0089577 discloses a mandolin slicer for slicing food items in variable thicknesses, which comprises a frame structure with two opposite side rails, a cutting blade mounted on a lower glide portion of the frame structure, and a slicing plate removably mounted on an upper glide portion of the frame structure between the two side rails. The removable slicing plate has a male portion to engage with a female portion such as an open hole arranged in a non-removable portion mounted on the frame structure, allowing for the interchange of the slicing plate with other types of removable slicing plates. But when it is needed to effect the interchange to provide different slicing patterns, the slicing plates may hurt the hands of the user because the user has to directly hold the slicing plates for interchange.

To avoid the direct contact with the slicing plates, U.S. application No. US2009/0255391 proposes a mandolin slicer comprising a frame structure with two opposite side rails, a cutting blade mounted on a lower glide portion of the frame structure, a slicing plate mounted on an upper glide portion of the frame structure between the two opposite side rails, and two arrays of slicing blades mounted on a selector slide which is movably mounted on the frame structure and below the slicing plate. The slicing plate has two sets of offset slots which are arranged in a front portion of the slicing plate. The user can manually adjust the selector slide to selectively pivot up the two arrays of slicing blades to protrude through the two sets of offset slots and above the surface of the slicing plate, so as to provide different patterns of arrangement of the slicing blades on the slicing plate. This thus enables different slicing patterns for food items, without the need to directly contact with the slicing blades so as to avoid the slicing blades to hurt the hands of the user. However, this mandolin slicer cannot provide variable slicing patterns for food items, due to the limitation of the arrangement of the only two arrays of slicing blades. Moreover, the structure of this mandolin slicer is very complicated and difficult to manufacture.

Thus, there is a need for a mandolin slicer kit assembly allowing for interchange of variable types of slicing plates without the need of direct contact between the hands of the user and the slicing plates.

SUMMARY OF THE INVENTION

An object of the present invention is to provide a mandolin slicer kit assembly for slicing an item which is flexible to change slicing plates to create variable slicing patterns of the item, and enables the user to implement the interchange without the need of directly contacting with the slicing plates, thereby avoiding the slicing plates to hurt the hands of the user.

The object of the present invention is achieved by providing a mandolin slicer comprising:

a main body having two opposite side panels;

a cutting blade mounted on the main body;

a slicing plate carrier mounted between the two side panels of the main body;

a plurality of slicing plates of different types, each of the slicing plates having a plurality of slicing teeth mounted on a top surface thereof and at least one recess formed on a bottom surface thereof;

an adapter plate having a leading portion, wherein said leading portion has at least one elastic rib for detachable engagement with the at least one recess of the slicing plate to form a slicing plate assembly, and said assembly detachably is mounted on the slicing plate carrier;

a slicing plate holder separate from the main body, said slicing plate holder having a plurality of receiving spaces for accommodating the plurality of slicing plates when they are detached from the adapter plate; and a mechanism provided in the slicing plate holder for releasing one of the slicing plates from the respective receiving space into the adapter plate for the engagement so as to form the slicing plate assembly to be mounted on the slicing plate carrier.

In a preferred embodiment of the invention, the slicing plate carrier has a V-shaped front portion corresponding to the cutting blade in V-shape. Preferably, each of the slicing plates has a front portion which is sized and shaped such that at least one part of the front portion of the slicing plate is inserted into a space defined by angular sides of the V-shaped cutting blade.

Preferably, the slicing plate carrier is adjustable vertically to provide variable slice thickness for an item to be sliced.

In a preferred embodiment of the invention, the slicing plate carrier has at least one raised lip formed along a front edge of the top surface thereof, each of the slicing plates has at least one cut-away area along a bottom edge thereof which is positioned to correspond to the raised lip of the slicing plate carrier, and engagement of the raised lip with the cut-away area prevents the slicing plate from sliding forward on the slicing plate carrier.

In a preferred embodiment of the invention, the detachable mounting of the slicing plate assembly on the slicing plate carrier is implemented by a locking means comprising:

an actuator running through a window formed on the slicer plate carrier and having a receptacle and a compression spring, wherein the receptacle is secured on a bottom surface of the slicing plate carrier, and the compression spring has one end fixed on a bottom of the receptacle; and a block element arranged in the receptacle and having a bottom surface fixed to the other end of the compression spring for allowing the block element to move up and down through the window, wherein the block element has a cam formed on one end thereof, and the cam is sized such that it protrudes beyond a top surface of the slicing plate carrier, thereby serving as a stop to prevent movement of the slicing plate assembly; downward movement of the block element enables the cam move down below the top surface of the slicing plate carrier to unlock the slicing plate assembly from the slicing plate carrier.

Preferably, the block element further comprises two legs extending from the other end thereof, and the cam abuts against an inner wall of the window of the slicing plate carrier, wherein the two legs are pivotally mounted on the bottom surface of the slicing plate carrier to enable pivotal movement of the block element, so that downward movement of the block allows the cam to disengage from the window and move down below the top surface of the slicing plate carrier to unlock the slicing plate assembly from the slicing plate carrier.

Preferably, the slicing plate assembly further comprises a button running through a window formed on the slicing plate assembly, and at least two elastic arms fixed to the button and secured on a bottom of the slicing plate assembly to provide elasticity of the button to move up and down; wherein downward movement of the button enables the downward movement of the block element to unlock the slicing plate assembly from the slicing plate carrier.

In a preferred embodiment of the invention, the slicing plate holder is provided as a multilayer structure. In this embodiment, the releasing mechanism in the slicing plate holder comprises:

a spring means with one end fixed to a bottom of the multilayer structure;

a post extending through all layers of the multilayer structure and having an end portion fixed to the other end of the spring means; and a plurality of hook members extending laterally from the post each engagable with a slot formed on a bottom surface of the respective slicing plate;

wherein application of a pressure to the other end of the post enables the hook members to move downward so as to disengage the hook members from the slicing plates to release the slicing plates.

In a preferred embodiment of the invention, the adapter plate and the slicing plates are engaged such that the slicing plate assembly has a flat top surface.

Unlike the mandolin slicers available in the prior art, the mandolin slicer kit assembly according to the invention allows the user to change the desirable slicing plate by holding the adapter plate rather than the slicing plate per se, as the adapter plate is devised to removably engage with the slicing plate. Another feature of the invention is the slicing plate holder which is configured to provide the mechanism for locking the slicing plates in place and releasing the slicing plates into the adapter plate. This prevents the hands of the user from direct contact with the slicing teeth to effect the interchange of different slicing plates.

BRIEF DESCRIPTION OF THE DRAWINGS

To have a better understanding of the invention reference is made to the following detailed description of the invention and embodiments thereof in conjunction with the following accompanying drawings.

DETAILED DESCRIPTION OF THE INVENTION

Figure 1:
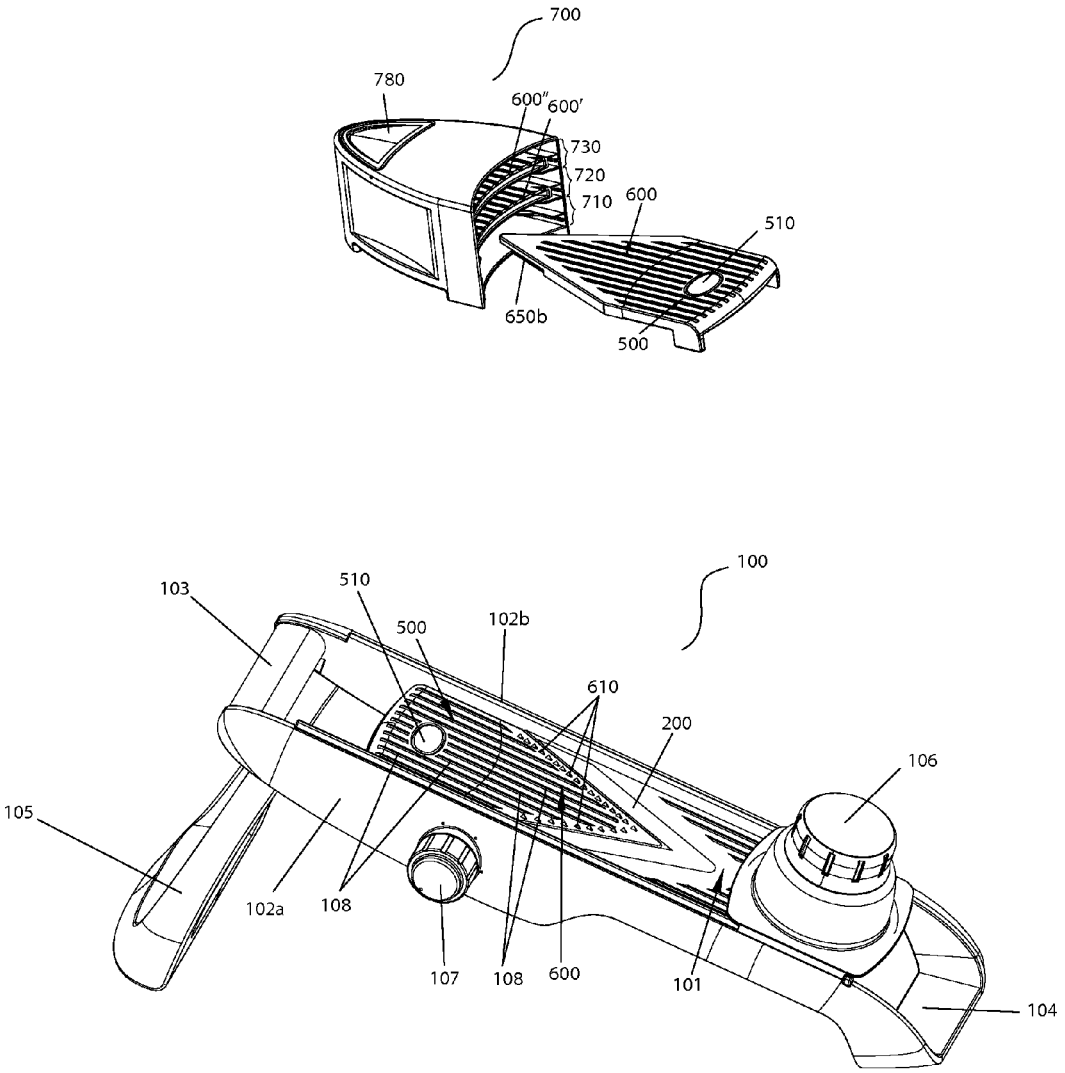
FIG. 1 shows a perspective view of a mandolin slicer kit assembly of a preferred embodiment according to the present invention.
Figure 2:
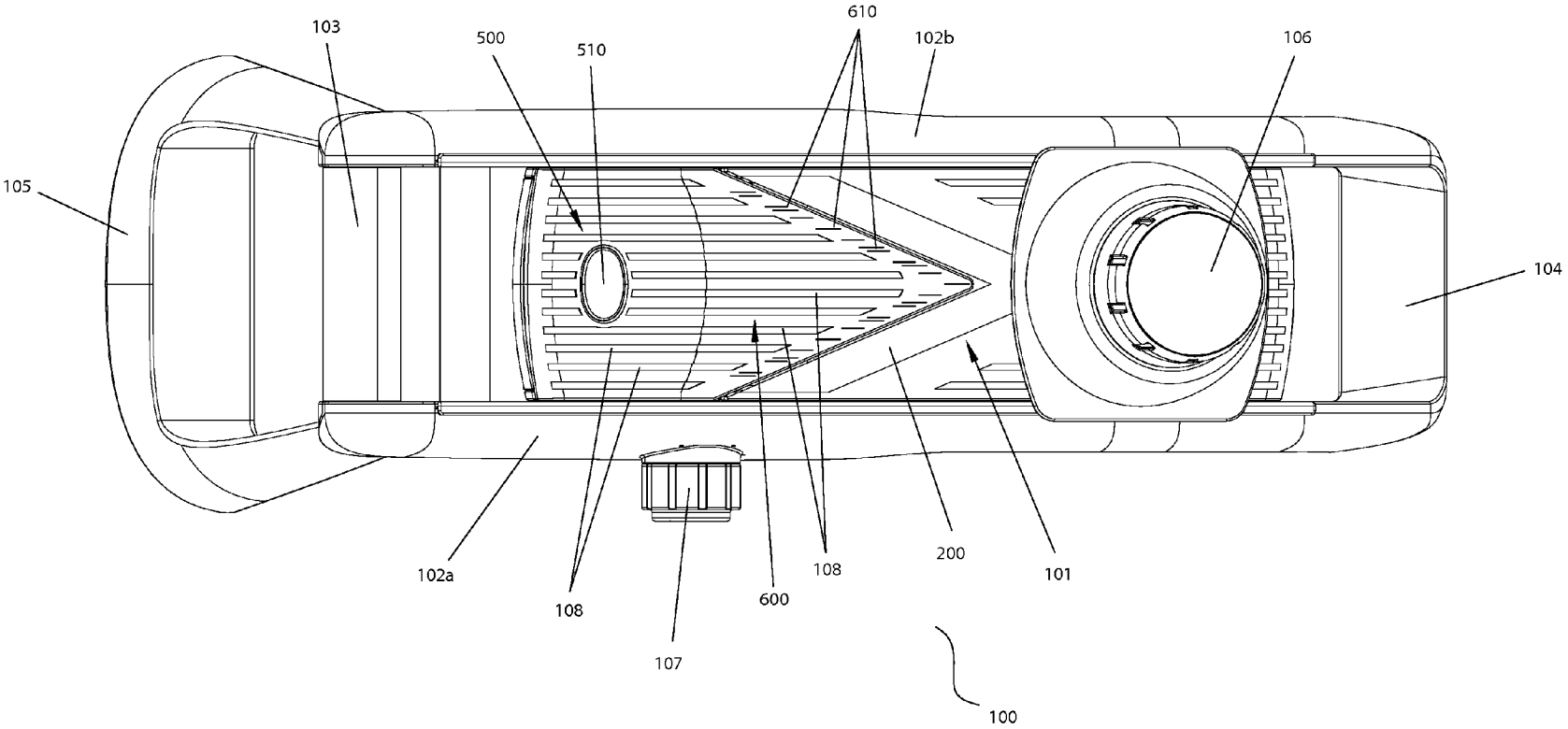
FIG. 2 shows a top view of the mandolin slicer kit assembly of FIG. 1.

While this invention is illustrated and described in preferred embodiments, the mandolin slicer kit assembly may be produced in many different configurations, sizes, forms and materials.

FIGS. 1 to 4 illustrate a mandolin slicer kit assembly for slicing an item such as a food item (not shown) advanced in a slicing direction according to a preferred embodiment of the present invention. In this embodiment, the mandolin slicer kit assembly comprises a main body 100 having two opposite and parallel side panels 102*a* and 102*b* and a cutting blade 200 mounted on the main body 100.

The main body 100 includes a handle 103 at a rear end thereof for ease of holding the mandolin slicer, a stand 105 which is pivotally mounted to the main body 100 such that the rear end of the main body 100 can be raised up in use, and a foot 104 at the other end of the main body 100. A holder assembly 106 is held between the two opposite side panels 102*a* and 102*b*. The holder assembly 106 comprises a needle to be inserted into the food item, such that the user can hold the holder assembly 106 to guide the food item along the two side panels 102*a* and 102*b* towards the cutting blade 200 so as to cut slices from the food item. The cutting blade 200 is mounted on a top surface of a glide section 101 of the main body 100 and has a cutting blade edge for cutting the food item. The cutting blade edge is V-shaped to ease the entrance of the cutting blade 200 into the item. These are not the essence of the invention and would be well known in the art, therefore will not be described in detail herein.

Figure 5:
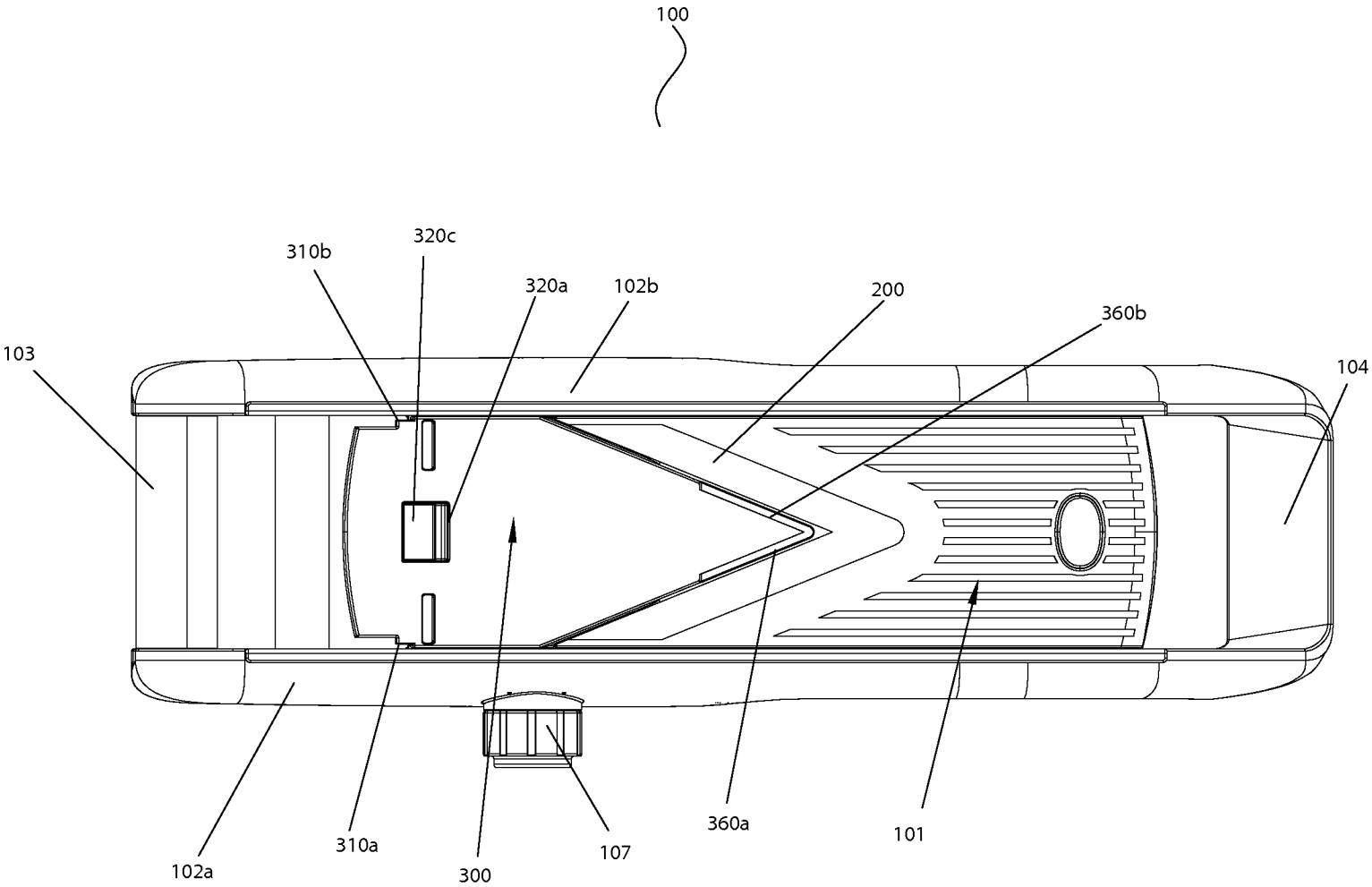
FIG. 5 shows a top view of a slicing plate carrier of the mandolin slicer kit assembly of FIG. 1.

The novel feature of the invention lies in the provision of a slicing plate carrier 300 and slicing plates 600, 600' and 600". As illustrated, the slicing plate carrier 300 is mounted between the side panels 102*a* and 102*b* of the main body 100 and has a V-shaped front portion corresponding to the cutting blade 200 in V-shape. Referring to FIG. 5, the slicing plate carrier 300 has two raised lips 360*a* and 360*b* formed along a front edge of the top surface of the slicing plate carrier 300.

The three slicing plates 600, 600' and 600" have the same dimension and structures except for the type of slicing teeth mounted on a respective top surface of the slicing plates. For the sake of clarity and convenience, the slicing plate 600 is taken herein as one example of the various slicing plates. It would be appreciated that the following description of the slicing plate 600 is applicable to the slicing plates 600' and 600".

Figure 6:
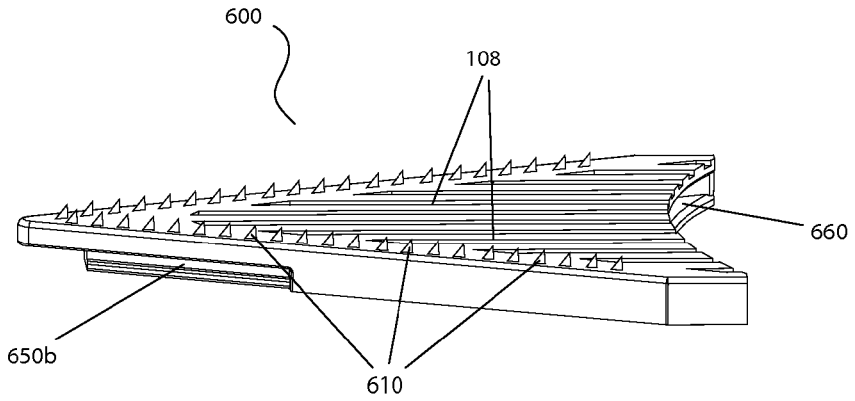
FIG. 6 shows an exemplary slicing plate of the mandolin slicer kit assembly of FIG. 1.
Figure 7:
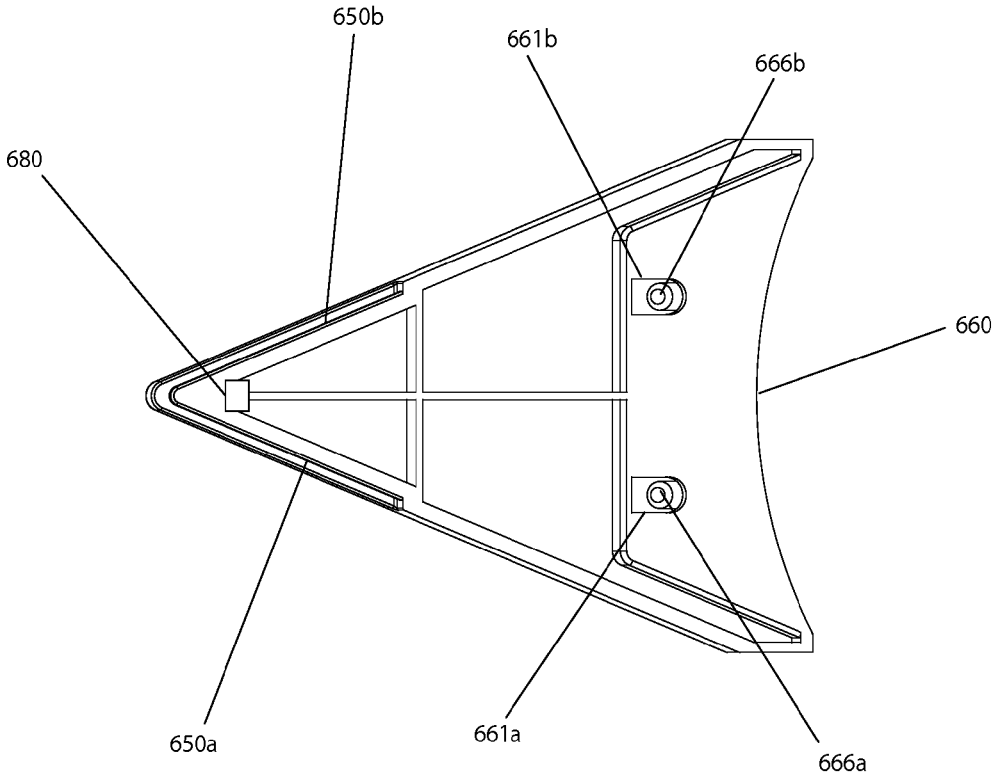
FIG. 7 shows a bottom view of the slicing plate of FIG. 6.

Referring to FIGS. 6 and 7, the slicing plate 600 has a front portion which is V-shaped to correspond to the V-shaped cutting blade 200, such that the front portion of the slicing plate 600 is inserted into a space defined by angular sides of the V-shaped cutting blade 200. The slicing plate 600 has a plurality of slicing teeth 610 on its top surface, and two recesses 666*a* and 666*b* formed on its bottom surface. The slicing plate 600 has two cut-away areas 650*a* and 650*b* along its two bottom edges. A lateral member 680 extends from the intersection of the two cut-away areas 650*a* and 650*b* (see FIG. 7). In this embodiment, a bottom plate is arranged in spaced relation with the slicing plate 600 to define a channel 660 for permitting and guiding insertion of a leading portion of an adapter plate 500, which will be described hereinafter. The bottom plate has two through holes 661*a* and 661*b* substantially positioned to correspond to the two recesses 666*a* and 666*b*.

Figure 4:
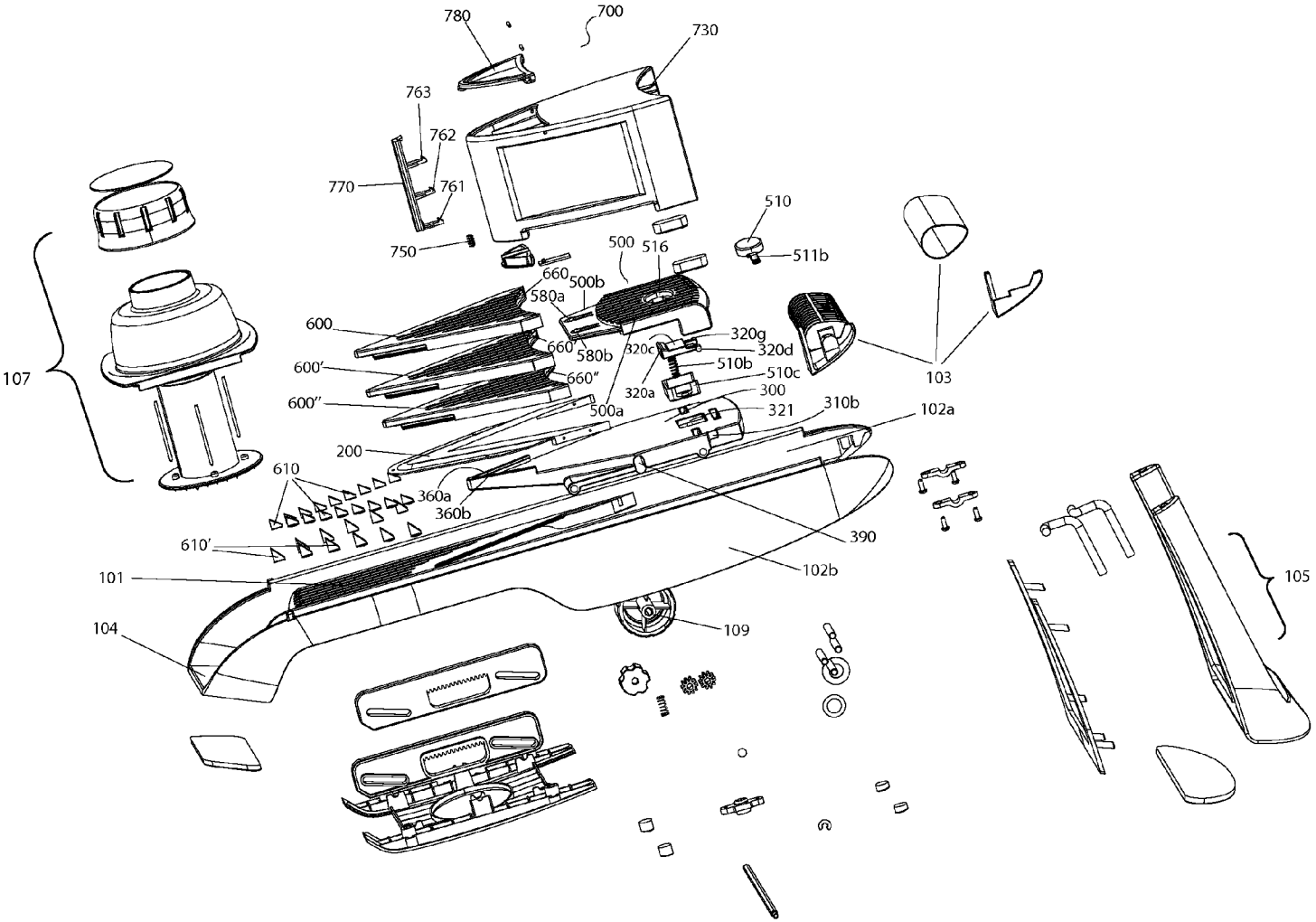
FIG. 4 shows an exploded view of the mandolin slicer kit assembly of FIG. 1.
Figure 8:
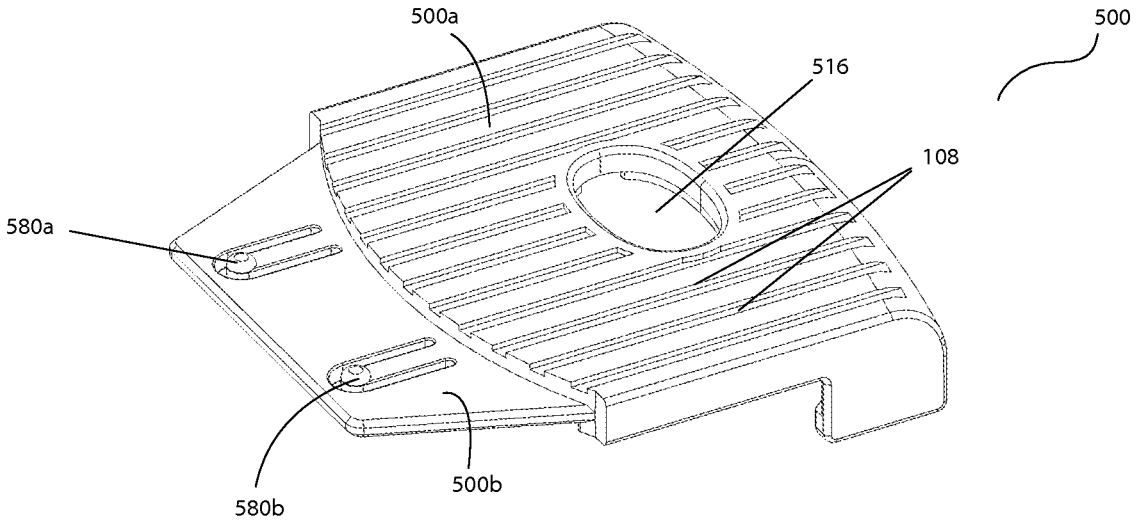
FIG. 8 shows a perspective view of an adapter plate of the mandolin slicer of FIG. 1.
Figure 9:
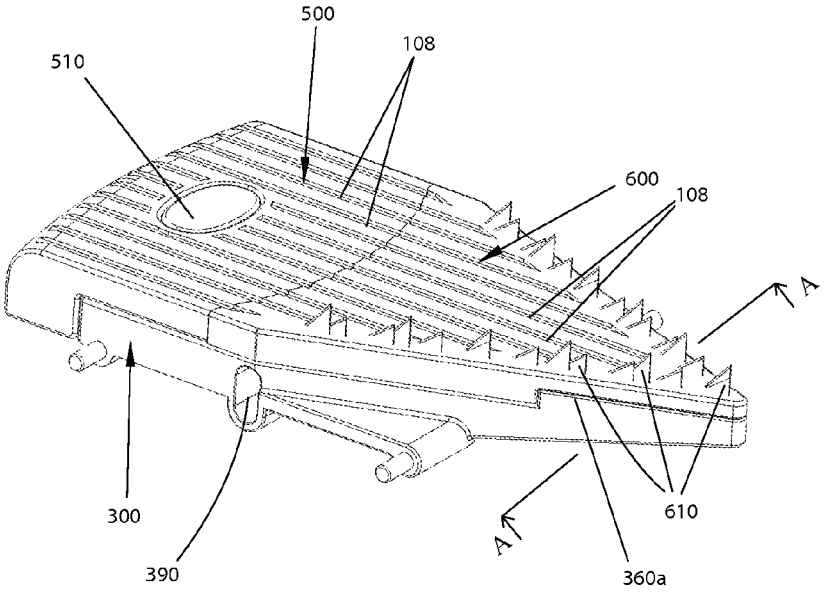
FIG. 9 shows a perspective view of a slicing plate assembly formed by the slicing plate and the adapter plate together and mounted on the slicing plate carrier of FIG. 5.
Figure 10:
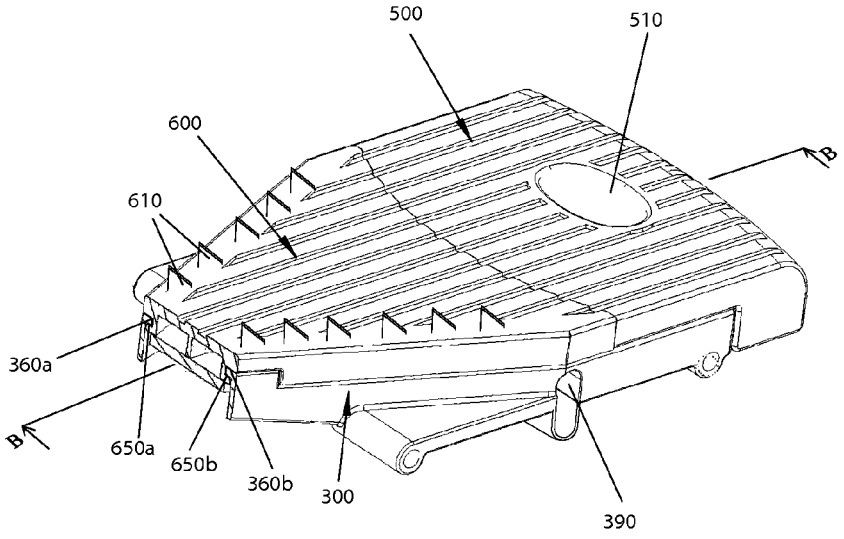
FIG. 10 shows a perspective view of the slicing plate assembly at a different angle with a sectional view taken along line A-A of FIG. 9.

As shown in FIGS. 4 and 8, the mandolin slicer kit assembly further comprises an adapter plate 500 which has a rear portion 500*a* and a leading portion 500*b* extending from the rear portion 500*a*. The leading portion 500*b* has two elastic ribs 580*a* and 580*b* for detachable engagement with the two recesses 666*a* and 666*b* formed on the slicing plate 600, such that the adapter plate 500 and the slicing plate 600 are secured together to form a slicing plate assembly. In this embodiment, the slicing plate assembly is of flat top surface. The leading portion 500*b* is sized to be inserted into the channel 660 below the slicing plate 600, which reinforce the engagement between the two plates 500 and 600. As discussed above, the bottom plate defining the channel 660 has the two through holes 661*a* and 661*b* positioned to correspond to the recesses 666*a* and 666*b*. Here, the through holes 661*a* and 661*b* allow the elastic ribs 580*a* and 580*b* to pass therethrough when the adapter plate 500 is forced to disengage from the slicing plate 600, thus providing the ease and flexibility of the disengagement of the adapter plate 500.

A plurality of guiding notches 108 in parallel to the two side panels 102*a* and 102*b* of the main body 100 may be configured on a top surface of the rear portion 500*a* of the adapter plate 500 and on a top surface of the slicing plate 600 for adjusting the slicing direction of the food item towards the cutting blade 200.

Now turning to FIGS. 9 to 18, there is illustrated how the slicing plate assembly formed by the slicing plate 600 and the adapter plate 500 is mounted on and removed from the slicing plate carrier 300. As discussed above, the slicing plate 600 has the two cut-away areas 650*a* and 650*b* along its two edges respectively positioned to correspond to the two raised lips 360*a* and 360*b* of the slicing plate carrier 300 such that they are engaged therebetween. The raised lips 360*a* and 360*b* also serve to prevent the slicing plate 600 from sliding forward along the slicing plate carrier 300.

On the opposite end of the raised lips 360*a* and 360*b*, there are formed two detents 310*a* and 310*b* (see FIGS. 12, 15 and 18) at both sides of the slicing plate carrier 300, and the adapter plate 500 has two corresponding catches inside which the detents 310*a* and 310*b* can engage. This engagement not only enables the engagement between the adapter plate 500 and the slicing plate carrier 300, but also serves to prevent the adapter plate 500 from slicing along the slicing plate carrier 300.

Figure 3:
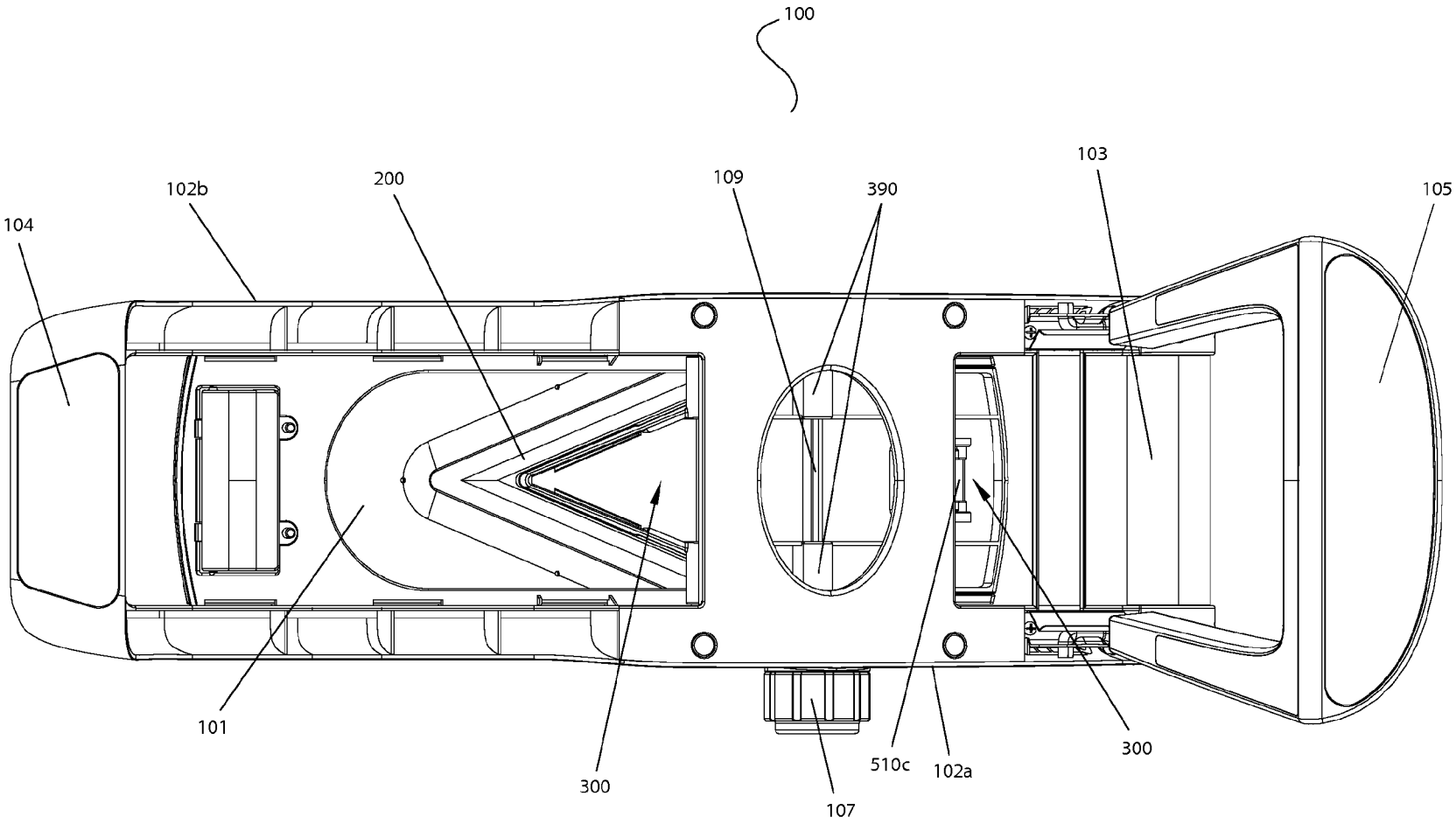
FIG. 3 shows a bottom view of the mandolin slicer kit assembly of FIG. 1.

The slicing plate carrier 300 is adjustable vertically to provide variable slice thicknesses of the food item to be sliced, which is well known in the art. In this embodiment, an adjustment knob 107 is secured with a cam axle 109 in order to vertically adjust the slicing plate carrier 300, as illustrated in FIG. 3. The cam axle 109 is rotatablely mounted between the two side panels 102*a* and 102*b*, and extends through a passage 390 arranged on a bottom surface of the slicing plate carrier 300. The rotation of the adjustment knob 107 enables the cam axle 109 to vertically adjust the slicing plate carrier 300 and thus the slicing plate assembly, so as to achieve variable slice thicknesses of the food item.

Referring to FIGS. 13 to 18, the mandolin slicer kit assembly further comprises a locking means for locking the slicing plate assembly on the slicing plate carrier 300. The locking means comprises an actuator and a block element 320. In this embodiment, the actuator comprises a button 510 running through a window 516 formed on the adapter plate 500, and a stub 510*a* extending from a bottom of the button 510 and in contact with the block element 320. Two elastic arms 511*a* and 511*b* extend respectively from the two ends of the button 510 to provide elasticity for movement of the bottom 510. The two elastic arms 511*a* and 511*b* are secured on the bottom of the adapter plate 500. The actuator further comprises a receptacle 510*c* secured on the bottom surface of the slicing plate carrier 300, for example, by screws, for receiving the block element 320. A compression spring 510*b* is received in the receptacle 510*c* and has one end fixed on the bottom of the receptacle 510*c* and the other end in abutment on the block element 320, such that the button 510 is pressed down to enable movement of the block element 320 due to the compression of the spring 510*b*.

Figure 11:
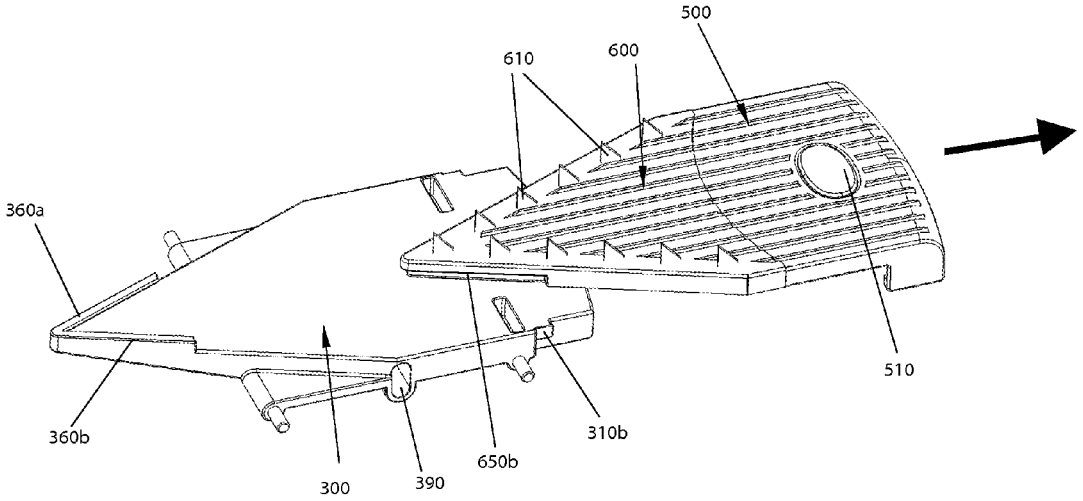
FIG. 11 shows the slicing plate assembly of FIG. 9 being released from the slicing plate carrier.
Figure 12:
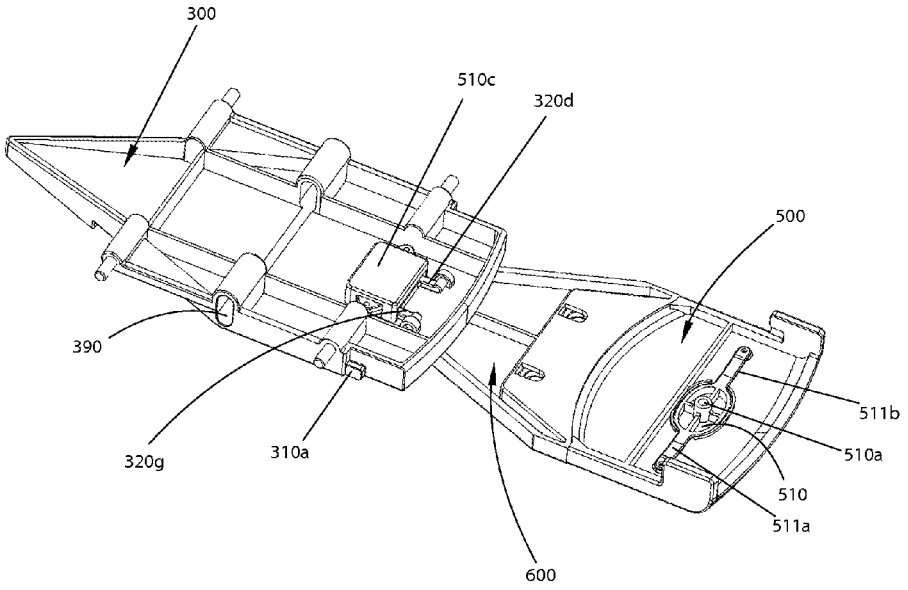
FIG. 12 shows a bottom view of the slicing plate assembly of FIG. 11.
Figure 13:
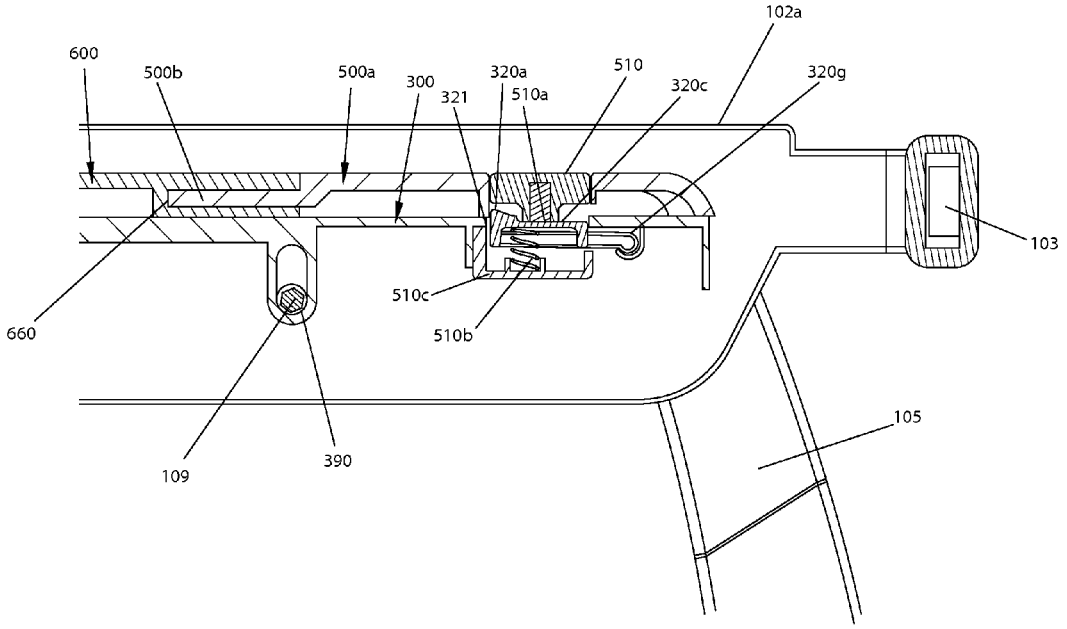
FIG. 13 shows a cross-sectional partial view of the slicing plate assembly taken along line B-B of FIG. 10 in locked position.
Figure 14:
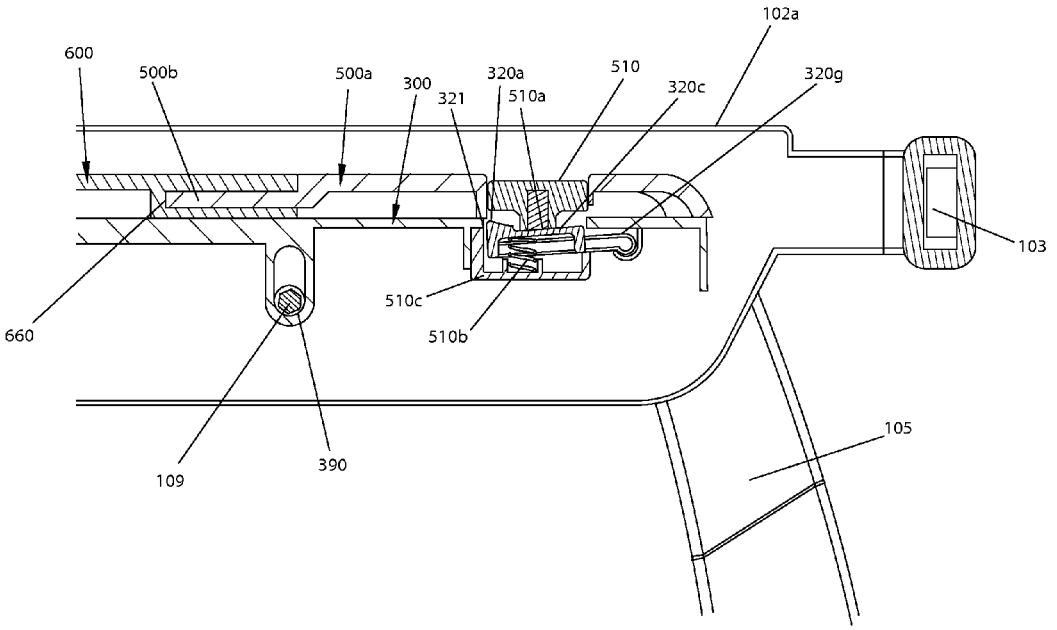
FIG. 14 shows a cross-sectional partial view of the slicing plate assembly taken along line B-B of FIG. 10 in unlocked position.
Figure 15:
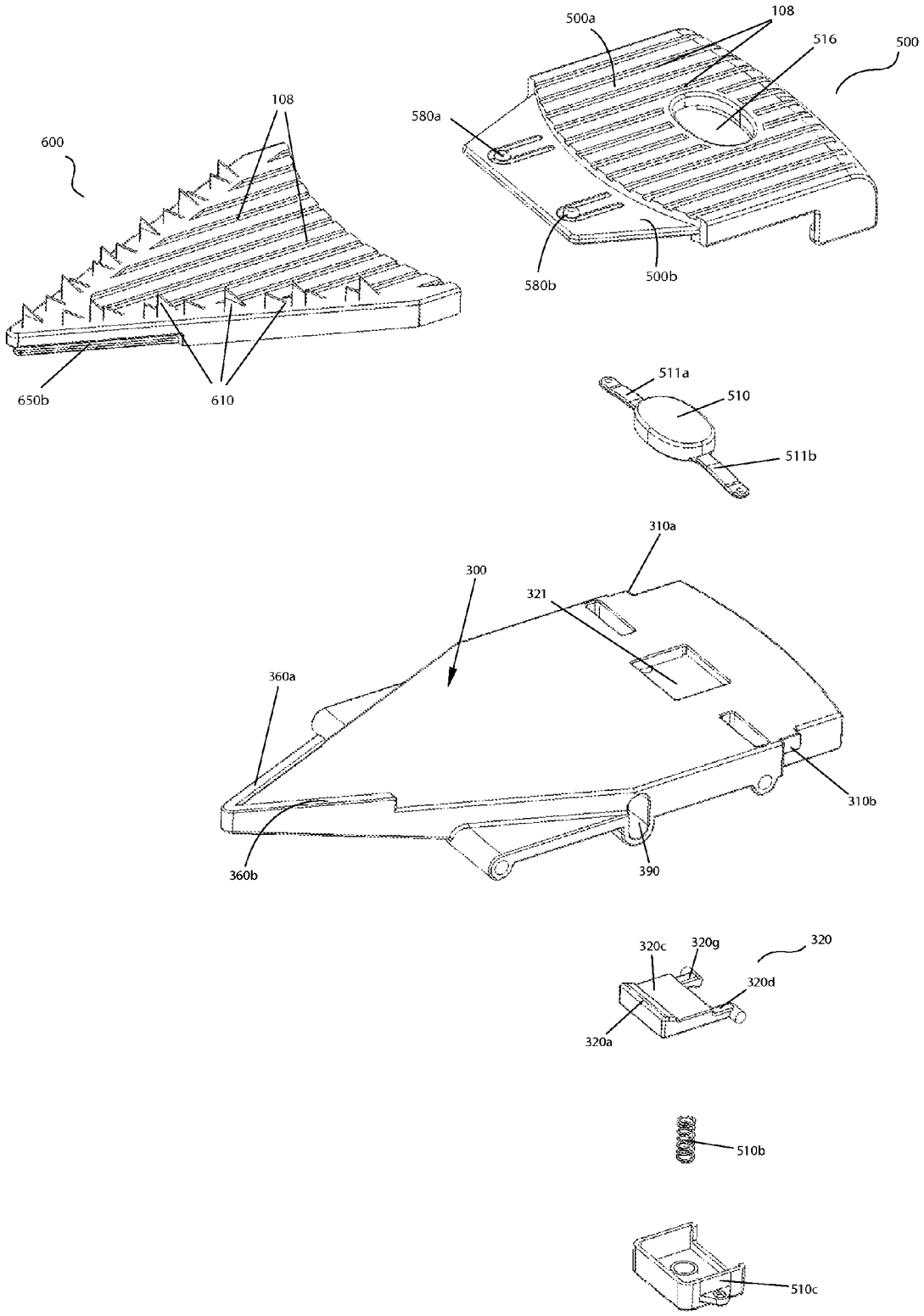
FIG. 15 shows an exploded view of a locking means of the mandolin slicer kit assembly according to a preferred embodiment of the invention.
Figure 16:
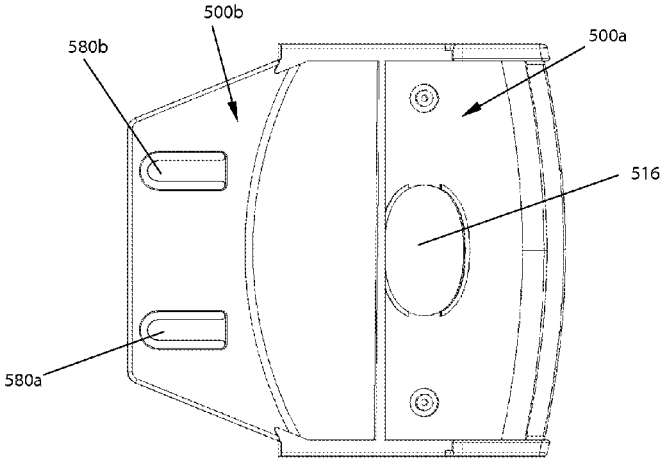
FIG. 16 shows a bottom view of the adapter plate of the slicing plate assembly.
Figure 17:
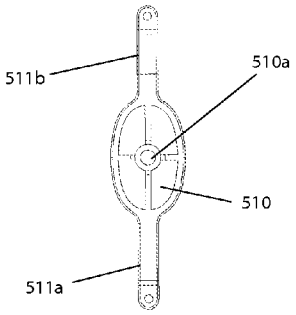
FIG. 17 shows a part of an exemplary actuator of the locking means.
Figure 18:
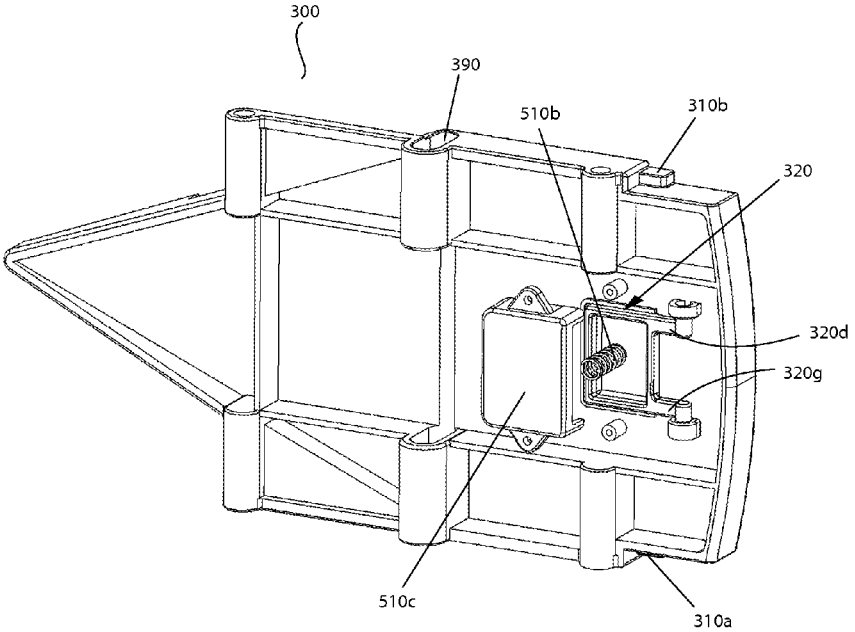
FIG. 18 shows a bottom view of the slicing plate carrier of FIG. 15.
Figure 19:
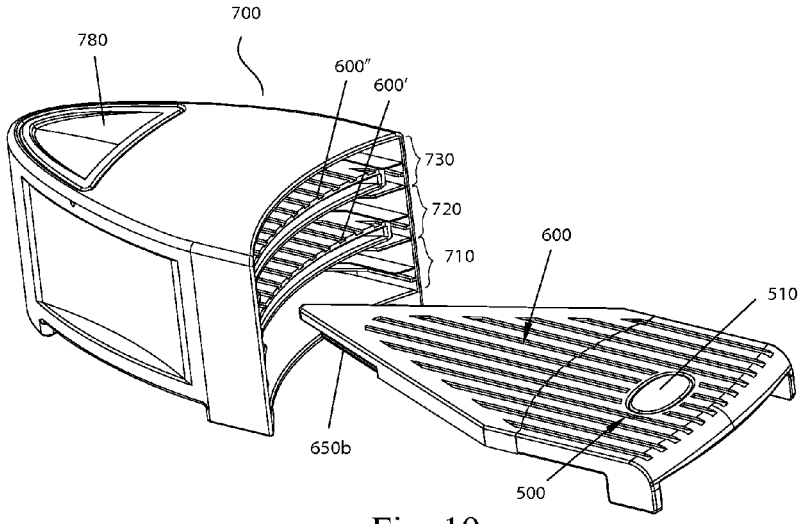
FIG. 19 shows a perspective view of a slicing plate holder of the mandolin slicer kit assembly according to a preferred embodiment of the invention with the slicing plate assembly being ready to be inserted into the slicing plate holder.

Referring to FIG. 15, the block element 320 is configured to have a cam 320*a* formed on one end thereof and two legs 320*d* and 320*g* extending from the opposite end. As clearly shown in FIG. 13, the cam 320*a* is sized such that it protrudes beyond a top surface of the slicing plate carrier 300 when the slicing plate assembly is locked onto the slicing plate carrier 300, thereby serving as a stop to prevent movement of the slicing plate assembly. The two legs 320*d* and 320*g* are pivotally mounted on the bottom surface of the slicing plate carrier 300 to enable pivotal movement of the block element 320 relative to the slicing plate carrier 300. The block element 320 has a top surface 320*c* that comes in direct contact with the stub 510*a* when the button 510 is pressed down, which in turn presses the block element 320 to pivot about the legs 320*d* and 320*g* and move down, such that the cam 320*a* disengages from the window 321 and move down below the top surface of the slicing plate carrier 300 to unlock the adapter plate 500, allowing the slicing plate assembly to be removed from the slicing plate carrier 300, as clearly shown in FIG. 14. FIG. 11 shows that the slicing plate assembly is removed from the slicing plate carrier 300 in the arrow direction.

Referring now to FIGS. 4, 19 to 23, another feature of the present invention is that the mandolin slicer kit assembly comprises a slicing plate holder 700 separate from the main body 100 for accommodating the plurality of slicing plates when they are detached from the adapter plate 500. As illustrated, the slicing plate holder 700 is provided as a three-layer structure defining three receiving spaces 710, 720 and 730 for accommodating the three slicing plates 600, 600' and 600". The slicing plate holder 700 further comprises a mechanism for releasing any one of the slicing plates from the respective receiving space in a manner that the released slicing plate is engaged with the adapter plate 500 to form the slicing plate assembly.

Figure 22:
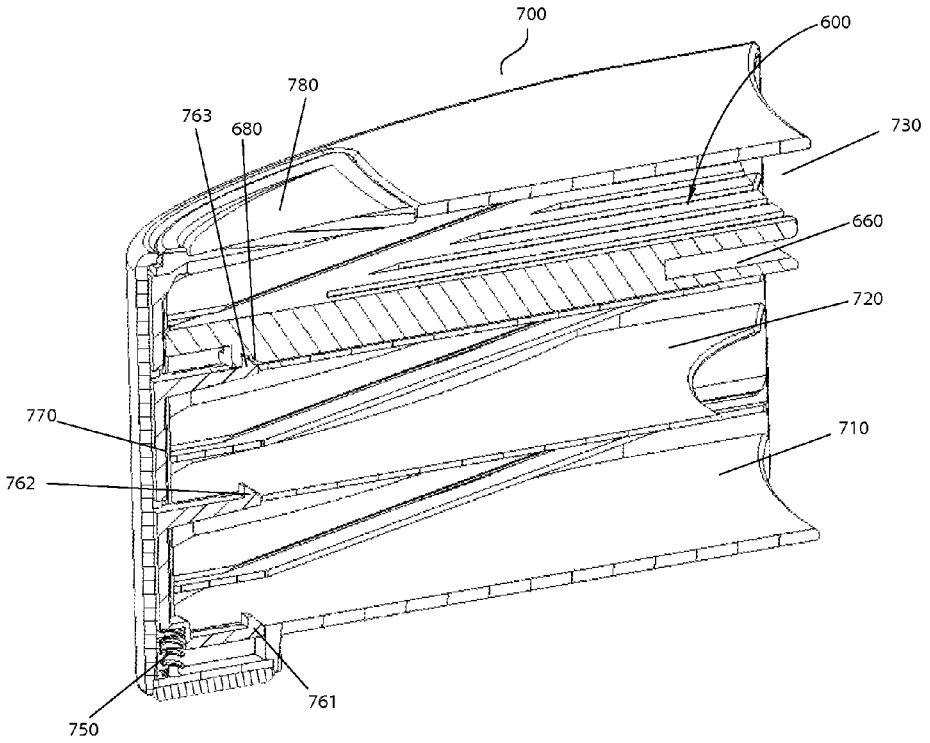
FIG. 22 shows a cross-sectional view of the slicing plate which is secured in the slicing plate holder in perspective view.
Figure 23:
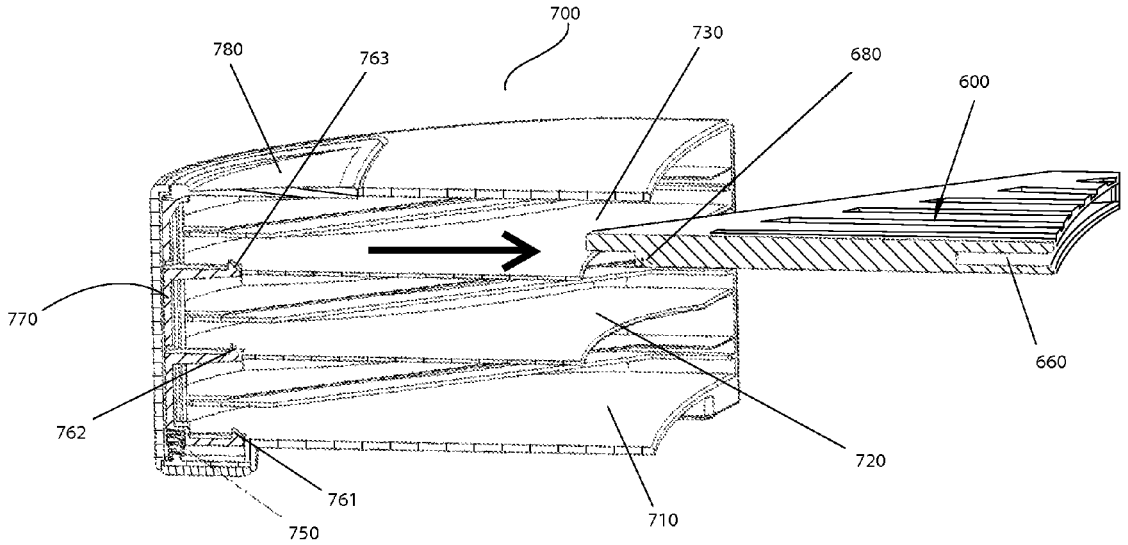
FIG. 23 shows a cross-sectional view of the slicing plate of FIG. 22 released from the slicing plate holder in perspective view.

As shown in FIGS. 4, 22 and 23, the releasing mechanism is arranged immediately adjacent to the inner wall of the side opposite to the insertion side within the slicing plate holder 700. For the sake of clarity and convenience, FIGS. 22 and 23 illustrate one slicing plate 600 only as an example, which is stored in the receiving space 730. The releasing mechanism comprises a spring means, a post 770 extending through the three receiving spaces 710, 720 and 730, and three hook members 761, 762 and 763 extending laterally from the post 770. The spring means is a compression spring 750 in this embodiment and has one end fixed to the bottom of the splicing plate holder 700 and the other end in abutment with the bottom of the post 770. The other end of the post 770 extends to the top of the slicing plate holder 700 and is coupled to a button 780. The hook members 761, 762 and 763 are fitted to the respective lateral members 680 formed on the bottom of the slicing plates, so that the slicing plates are secured inside the slicing plate holder 700, as shown in FIG. 22. When the button 780 is pushed down, the spring 750 is compressed to drive downward movement of the post 770 along with the hook members 761, 762 and 763, thereby the hook members are disengaged from the respective lateral members 680, at this point the slicing plates may be released from the slicing plate holder 700, as clearly shown in FIG. 23.

Figure 20:
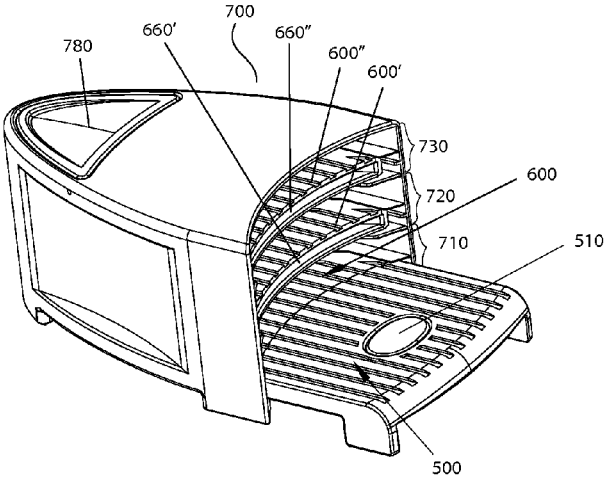
FIG. 20 shows a perspective view of the slicing plate holder of FIG. 19 with the slicing plate in place and the adapter plate still being engagable therewith.
Figure 21:
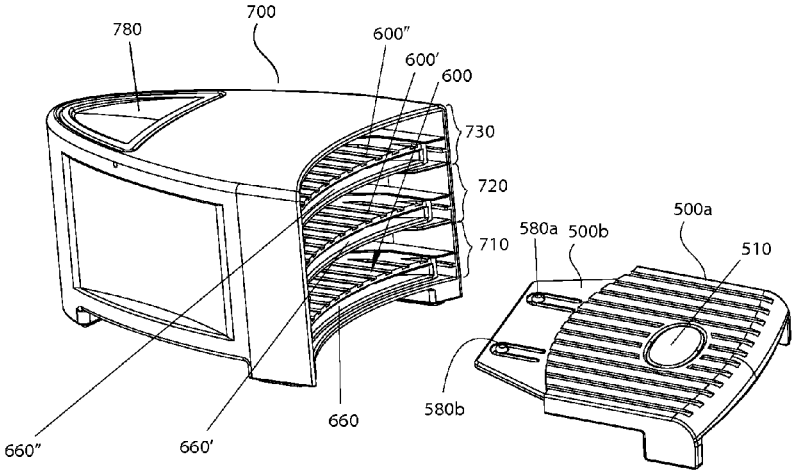
FIG. 21 shows a perspective view of the slicing plate holder of FIG. 20 with the adapter plate disengagable from the slicing plate.

Now turning back to FIGS. 19 to 21, FIG. 19 shows that the slicing plate assembly formed by the slicing plate 600 and the adapter plate 500 is ready to be inserted into the receiving space 710. FIG. 20 shows that the slicing plate assembly is inserted into the receiving space 710, with the slicing plate 600 being in place in the receiving space 710. FIG. 21 shows that the adapter plate 500 is detached from the slicing plate 600.

In operation, the user holds the slicing plate assembly by grasping the adapter plate 500 and inserts the slicing plate 600 into the receiving space 710. The slicing plate 600 is positioned and secured in place after its lateral member 680 is fitted to the hook member 761. Afterwards, the user pulls back the adapter plate 500 to disengage the two elastic ribs 580*a* and 580*b* formed on the leading portion 500*b* thereof from the two recesses 666*a* and 666*b* formed on the slicing plate 600, at which time the adapter plate 500 and the slicing plate 600 are no longer secured together. Then the user further pulls the adapter plate 500 back to allow the leading portion 500*b* of the adapter plate 500 to come out of the channel 660 of the slicing plate 600 (see FIG. 21).

When it is desired to take the slicing plate 600 out of the slicing plate holder 700, the user may grasp the adapter plate 500 and insert the leading portion 500*b* into the channel 660 of the slicing plate 600. After the engagement of the two elastic ribs 580*a* and 580*b* formed on the leading portion 500*b* of the adapter plate 500 with the two recesses 666*a* and 666*b* formed on the slicing plate 600, the two plates 500 and 600 are secured together to form the slicing plate assembly. Then, the user may press down the button 780 on the top of the slicing plate holder 700 to disengage the respective hook member 763 of the releasing mechanism from the lateral member 680, at which time the slicing plate assembly is no long constrained to the slicing plate holder 700. Now the user may grasp the adapter plate 500 to pull the whole slicing plate assembly back until the assembly comes out of the slicing plate holder 700, and subsequently hold and mount the assembly on the slicing plate carrier 300 for slicing operation as discussed above.

As can be seen, the user can implement the slicing operation, change and store the slicing plate without the need of direct contact with the slicing plate with the slicing teeth, thereby preventing the hands of the user from being hurted. The arrangement of the slicing plate holder 700 permits to store various types of slicing plates, providing the variety of the slicing patterns.

The invention thus provides a mandolin slicer kit assembly which allows for interchange of slicing plates of variable slicing teeth to achieve variable slicing patterns without the need of direct contact between the user and the slicing plates thereby preventing the hands of the user from getting hurted.

Although the nature of the present invention has been described in detail by the above preferred embodiments, the invention is not limited to these embodiments. Various amendments, modifications and alterations may be made to the invention without departing from the sprit and scope of the invention, but these amendments, modifications and alterations shall fall into the scope of the invention.

What is claimed is:

1. A mandolin slicer kit assembly comprising:

a main body having two opposite side panels;

a cutting blade mounted on the main body;

a slicing plate carrier mounted between the two side panels of the main body;

a plurality of slicing plates of different types, each of the slicing plates having a plurality of slicing teeth mounted on a top surface thereof and at least one recess formed on a bottom surface thereof;

an adapter plate having a leading portion, wherein said leading portion has at least one elastic rib for detachable engagement with the at least one recess of one of the plurality of slicing plates to form a slicing plate assembly, and said assembly is detachably mounted on the slicing plate carrier;

a slicing plate holder separate from all of the main body, the cutting blade, the slicing plate carrier and the adapter plate, said slicing plate holder having a plurality of receiving spaces for accommodating the plurality of slicing plates when they are detached from the adapter plate, said sliding plate holder being provided as a multilayer structure; and a mechanism provided in the slicing plate holder for releasing one of the slicing plates from the respective receiving space onto the adapter plate for the engagement so as to form the slicing plate assembly to be mounted on the slicing plate carrier, whereby the mechanism in the slicing plate holder comprises:

a spring means with one end fixed to a bottom of the multilayer structure;

a post extending through all layers of the multilayer structure and having an end portion fixed to the other end of the spring means; and a plurality of hook members extending laterally from the post each engagable with a lateral member formed on a bottom surface of the respective slicing plate;

wherein application of a pressure to the other end of the post enables the hook members to move downward so as to disengage the hook members from the slicing plates to release the slicing plates.

2. The mandolin slicer kit assembly according to claim 1, characterized in that the cutting blade is in V-shape, and that the slicing plate carrier has a V-shaped front portion corresponding to the cutting blade in V-shape.

3. The mandolin slicer kit assembly according to claim 2, characterized in that each of the slicing plates has a front portion which is sized and shaped such that at least one part of the front portion of the slicing plate is inserted into a space defined by angular sides of the V-shaped cutting blade.

4. The mandolin slicer kit assembly according to claim 1, characterized in that the slicing plate carrier is adjustable vertically to provide variable slice thickness for an item to be sliced.

5. The mandolin slicer kit assembly according to claim 1, characterized in that the slicing plate carrier has at least one raised lip formed along a front edge of the top surface thereof, each of the slicing plates has at least one cut-away area along a bottom edge thereof which is positioned to correspond to the raised lip of the slicing plate carrier, and engagement of the raised lip with the cut-away area prevents the slicing plate from sliding forward on the slicing plate carrier.

6. The mandolin slicer kit assembly according to claim 1, characterized in that the detachable mounting of the slicing plate assembly on the slicing plate carrier is implemented by a locking means comprising:

an actuator running through a window formed on the slicer plate carrier and having a receptacle and a compression spring, wherein the receptacle is secured on a bottom surface of the slicing plate carrier, and the compression spring has one end fixed on a bottom of the receptacle; and a block element arranged in the receptacle and having a bottom surface fixed to the other end of the compression spring for allowing the block element to move up and down through the window, wherein the block element has a cam formed on one end thereof, and the cam is sized such that it protrudes beyond a top surface of the slicing plate carrier, thereby serving as a stop to prevent movement of the slicing plate assembly; downward movement of the block element enables the cam move down below the top surface of the slicing plate carrier to unlock the slicing plate assembly from the slicing plate carrier.

7. The mandolin slicer kit assembly according to claim 6, characterized in that the block element further comprises two legs extending from the other end thereof, and the cam abuts against an inner wall of the window of the slicing plate carrier, wherein the two legs are pivotally mounted on the bottom surface of the slicing plate carrier to enable pivotal movement of the block element, so that downward movement of the block element allows the cam to disengage from the window and move down below the top surface of the slicing plate carrier to unlock the slicing plate assembly from the slicing plate carrier.

8. The mandolin slicer kit assembly according to claim 6, characterized in that the actuator comprises a button running through a window formed on the slicing plate assembly, and at least two elastic arms fixed to the button and secured on a bottom of the slicing plate assembly to provide elasticity of the button to move up and down; wherein downward movement of the button enables the downward movement of the block element to unlock the slicing plate assembly from the slicing plate carrier.

9. The mandolin slicer kit assembly according to claim 7, characterized in that the actuator comprises a button running through a window formed on the slicing plate assembly, and at least two elastic arms fixed to the button and secured on a bottom of the slicing plate assembly to provide elasticity of the button to move up and down; wherein downward movement of the button enables the downward movement of the block element to unlock the slicing plate assembly from the slicing plate carrier.

10. The mandolin slicer kit assembly according to claim 1, characterized in that the slicing plate holder is provided as a multilayer structure.

11. The mandolin slicer kit assembly according to claim 10, characterized in that the mechanism in the slicing plate holder comprises:

a spring means with one end fixed to a bottom of the multilayer structure;

a post extending through all layers of the multilayer structure and having an end portion fixed to the other end of the spring means; and a plurality of hook members extending laterally from the post each engagable with a lateral member formed on a bottom surface of the respective slicing plate;

wherein application of a pressure to the other end of the post enables the hook members to move downward so as to disengage the hook members from the slicing plates to release the slicing plates.

12. The mandolin slicer kit assembly according to claim 1, characterized in that the adapter plate and the slicing plates are engaged such that the slicing plate assembly has a flat top surface with the slicing teeth extending from said flat top surface.

* * * * *